US009038742B2

(12) United States Patent
Porterfield, Jr. et al.

(10) Patent No.: US 9,038,742 B2
(45) Date of Patent: May 26, 2015

(54) SUPPRESSANT ACTUATOR

(75) Inventors: John Wright Porterfield, Jr., Raleigh, NC (US); Andrew W. Phillips, Rochester, NY (US); David Frasure, Wilson, NC (US); George F. Howard, Jr., Cape Vincent, NY (US)

(73) Assignees: KIDDE TECHNOLOGIES, INC., Wilson, NC (US); G.W. LISK COMPANY, INC., Clifton Springs, NY (US)

( * ) Notice: Subject to any disclaimer, the term of this patent is extended or adjusted under 35 U.S.C. 154(b) by 504 days.

(21) Appl. No.: 13/398,156

(22) Filed: Feb. 16, 2012

(65) Prior Publication Data

US 2013/0032741 A1 Feb. 7, 2013

Related U.S. Application Data

(60) Provisional application No. 61/514,145, filed on Aug. 2, 2011.

(51) Int. Cl.

| | |
|---|---|
| ***A62C 3/00*** | (2006.01) |
| ***A62C 13/00*** | (2006.01) |
| ***A62C 13/62*** | (2006.01) |
| ***A62C 37/40*** | (2006.01) |
| ***A62C 35/02*** | (2006.01) |
| ***A62C 37/36*** | (2006.01) |
| ***A62C 3/07*** | (2006.01) |
| ***A62C 37/46*** | (2006.01) |

(52) U.S. Cl.

CPC ..... *A62C 37/40* (2013.01); *A62C 35/023* (2013.01); *A62C 37/04* (2013.01); *A62C 3/07* (2013.01); *A62C 37/46* (2013.01)

(58) Field of Classification Search

CPC ..... A62C 3/07; A62C 35/023; A62C 37/04; A62C 37/46

USPC ..... 169/46, 60, 61, 62, 71, 72, DIG. 3; 251/68, 74, 129.15, 129.2

See application file for complete search history.

(56) References Cited

U.S. PATENT DOCUMENTS

| | | | |
|---|---|---|---|
| 1,510,445 | A | 9/1924 | Henry |
| 3,407,879 | A | 10/1968 | O'Rear |
| 3,468,169 | A | 9/1969 | Welch |

(Continued)

FOREIGN PATENT DOCUMENTS

| | | | |
|---|---|---|---|
| JP | 2009160383 | | 7/2009 |
| KR | 20-0285159 | * | 8/2002 |

(Continued)

OTHER PUBLICATIONS

Korean Office Action for Korean Patent Application No. 10-2012-82240 dated Jun. 25, 2013.

(Continued)

*Primary Examiner* — Ryan Reis

(74) *Attorney, Agent, or Firm* — Carlson, Gaskey & Olds, P.C.

(57) ABSTRACT

An exemplary suppressant actuator assembly includes a release member movable from a first position that restricts flow of a suppressant to a second position that permits flow of a suppressant. A biasing member moves from a more-biased position to a less-biased position to move the release member from the first position to the second position. A solenoid is activated to permit movement of the biasing member.

20 Claims, 5 Drawing Sheets

(56) References Cited

U.S. PATENT DOCUMENTS

| | | | | |
|---|---|---|---|---|
| 3,563,098 | A | | 2/1971 | Gley |
| 3,643,515 | A | * | 2/1972 | Hansen et al. ..... 74/2 |
| 3,730,005 | A | | 5/1973 | Hjermstad et al. |
| 4,004,488 | A | | 1/1977 | Williams |
| 4,011,911 | A | | 3/1977 | Gow |
| 4,159,744 | A | * | 7/1979 | Monte et al. ..... 169/26 |
| 4,637,473 | A | | 1/1987 | Gillis et al. |
| 4,688,438 | A | | 8/1987 | Bohler et al. |
| 4,887,674 | A | | 12/1989 | Galosky et al. |
| 4,891,994 | A | | 1/1990 | Barba |
| 4,974,812 | A | | 12/1990 | Fleming |
| 5,055,643 | A | | 10/1991 | Pardini et al. |
| 5,207,618 | A | | 5/1993 | Nishizawa |
| 5,771,742 | A | | 6/1998 | Bokaie et al. |
| 5,918,681 | A | | 7/1999 | Thomas |
| 6,702,033 | B1 | | 3/2004 | Mitchell et al. |
| 6,785,168 | B2 | | 8/2004 | Yoon |
| 7,201,619 | B1 | | 4/2007 | Viggiano et al. |
| 7,553,205 | B2 | | 6/2009 | LoSchiavo et al. |
| 2002/0189824 | A1 | | 12/2002 | Joseph |
| 2005/0199081 | A1 | * | 9/2005 | Gressel ..... 74/2 |
| 2006/0016608 | A1 | | 1/2006 | Simpson et al. |
| 2006/0091683 | A1 | | 5/2006 | Hawthorne |
| 2007/0007020 | A1 | | 1/2007 | Chase |
| 2011/0168416 | A1 | | 7/2011 | Frasure et al. |
| 2012/0318534 | A1 | | 12/2012 | Dahlgren et al. |
| 2014/0048330 | A1 | | 2/2014 | Frasure et al. |

FOREIGN PATENT DOCUMENTS

| | | | |
|---|---|---|---|
| KR | 10-2007-0016590 | * | 2/2007 |
| KR | 10-20070016590 | | 2/2007 |

OTHER PUBLICATIONS

First Examination Report for Australian Patent Application No. 2012208982 dated Aug. 7, 2013.

Search Report and Written Opinion for Singapore Patent Application No. 201205635-4 dated Jul. 22, 2013.

* cited by examiner

SUPPRESSANT ACTUATOR

CROSS-REFERENCE TO RELATED APPLICATIONS

This disclosure claims priority to U.S. Provisional Application No. 61/514,145, which was filed on 2 Aug. 2011 and is incorporated herein by reference.

BACKGROUND

This disclosure relates to suppressants and, more particularly, to a suppressant actuator having a biasing member and a solenoid.

Suppression systems, such as fire suppression systems, include a suppressant. Moving an actuator of these systems to an open position releases the suppressant. The released suppressant may be used to extinguish or suppress a fire. Suppression systems operate in many environments.

Many fire suppression systems include pyrotechnic-based piston actuators. Such actuators are particularly prone to wear due to environmental conditions. Thus, to avoid actuator faults, the pyrotechnic-based piston actuators are periodically inspected and replaced. Inspection and replacement is costly.

SUMMARY

An exemplary suppressant actuator assembly includes a release member movable from a first position that restricts flow of a suppressant to a second position that permits flow of a suppressant. A biasing member moves from a more-biased position to a less-biased position to move the release member from the first position to the second position. A solenoid is activated to permit movement of the biasing member.

An exemplary suppression system includes a controller and a supply of a suppressant. A release member is moveable from a first position to a second position. The second position permits more flow of the suppressant from the supply than the first position. A biasing member moves from a more-biased position to a less-biased position to move the release member from the first position to the second position. A solenoid is activated in response to a command from the controller to initiate movement of the biasing member from the more-biased position to the less-biased position.

An exemplary method of activating a suppression system includes activating a solenoid to permit movement of a biasing member. The method then uses the biasing member to move a release member from a first position that restricts flow of a suppressant to a second position that permits flow of a suppressant.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
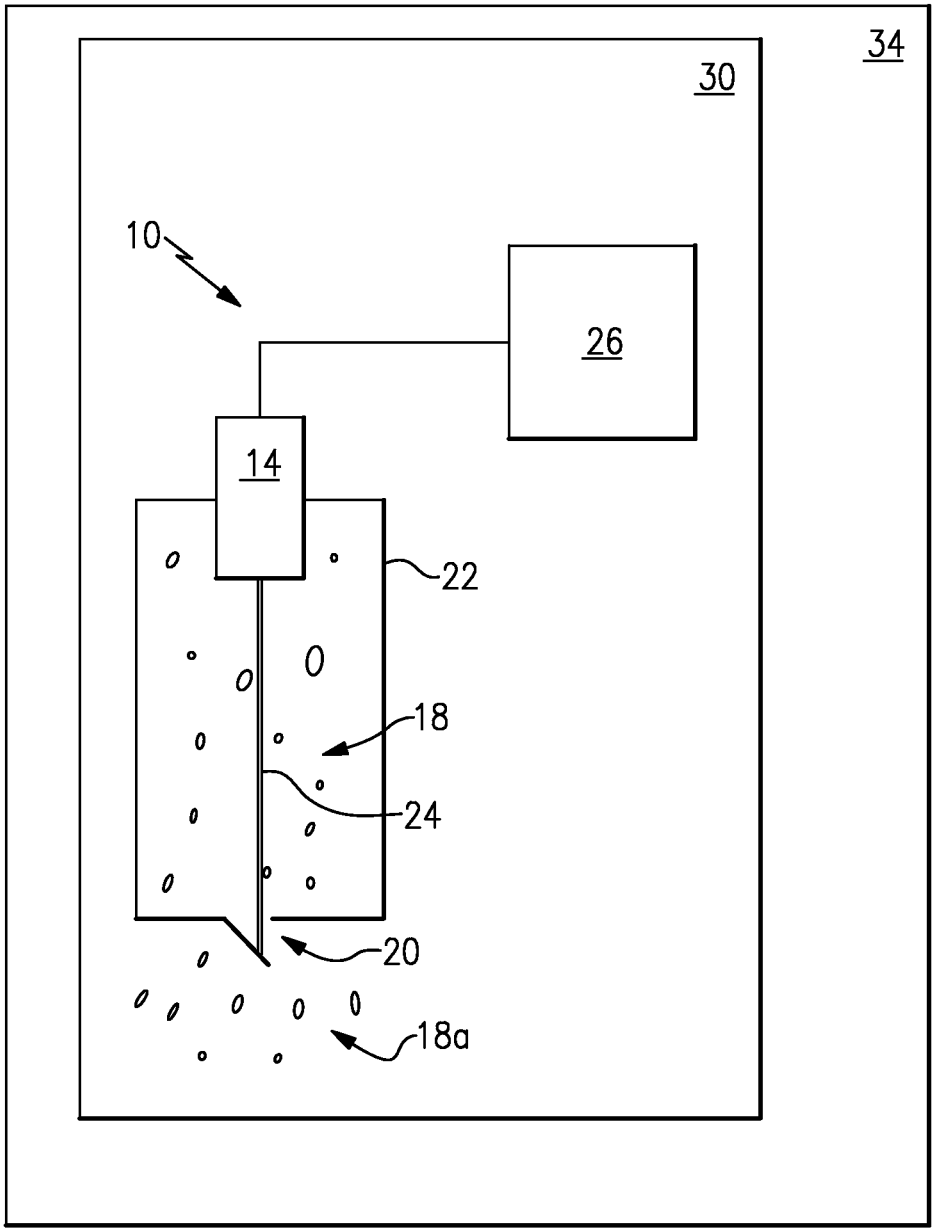
FIG. 1 shows a schematic view of an example suppression system.

Referring to FIG. 1, an example suppression system 10 includes a suppressant actuator assembly 14 that controls flow of a stored suppressant 18 from a supply 22 in a second position. The supply 22 and the actuator 14 are together considered a fire extinguisher, for example.

The suppressant actuator 14 moves a release member 56 (FIG. 2) between a first, unreleased position in which suppressant 18 is stored under pressure and opening 20 within the supply 22 is closed, and a second, released position, in which opening 20 is open. The release member 56 may be part of or connected to a piston assembly 24. The piston assembly 24, for example includes the structures extending from the actuator 14 to the opening 20 of the supply 22. In some examples, the piston assembly 24 may be a single structure.

The movement of the piston assembly 24 between the first position and the second position is controlled through a controller 26 that sends an electrical signal to the suppressant actuator 14 to move the piston assembly 24 (FIG. 2) from the first position to the second position. The controller 26 may send the electrical signal in response to various events. In one example, the controller 26 initiates movement in response to a particular thermal energy level. In another example, the controller 26 initiates movement based on a visual detection of a fire. In still other examples, the controller 26 initiates release of the suppressant 18 in response to a manual command from an operator.

In moving the release member 56 from the first position to the second position, the release member 56 moves the piston assembly 24 such that an opening 20 in the supply 22 is established, allowing the pressurized, stored suppressant 18, within the supply 22 to release suppressant 18*a* through the opening 20, for example into an engine bay 30.

In this example, the suppressant actuator 14 is a single-use actuator that moves the piston assembly 24 from the first position to the second position one time only. In other examples, the suppressant actuator 14 moves the piston assembly 24 back and forth between first position and the second position as well as to mid-positions between the first and second positions.

While the suppressant actuator 14 is shown in FIG. 1 as extending partially outside of the supply 22 and separate from the piston assembly 24, alternatively, the actuator 14 and the supply 22 may be joined as a single unit that is placed completely inside of or within the supply 22.

The suppression system 10 of FIG. 1 may be held within an engine bay 30 of a vehicle 34. Suppressant 18*a* released from the supply 22 extinguishes fires within the vehicle 34 and particularly within the engine bay 30. In other examples, the suppressant actuator 14 is used in a crew bay, dry bay, or externally to a vehicle 34. The suppression system 10 may suppress explosions as well.

The suppressant 18 may take many forms. In one example, the suppressant includes dry chemicals. In other embodiments, the suppressant may include liquid, foam or gaseous suppressants.

Referring now to FIGS. 2-5 with continuing reference to FIG. 1, the example suppressant actuator 14 includes a solenoid assembly 50 and a biasing assembly 54. The biasing assembly 54 of the present invention preferably includes a biasing member 62, a radial flange 74, a plurality of ball bearings 112, and a release member 56. A first end 29 of the piston assembly 24 is received within the suppressant actuator 14 and is connected to the release member 56.

When the release member 56, connected to the piston assembly 24, is moved to the second position by the suppressant actuator 14, a second end portion 144 of the piston assembly 24 is forced through rupture disk 148 to create a hole 20. The stored suppressant 18 then escapes from the supply 22 through the hole 20 in the rupture disk 148.

The solenoid 51 of the suppressant actuator 14 maintains the position of the release member 56 and thus the position of the piston assembly 24 until the controller 26 sends an electrical signal to the solenoid 51.

The suppressant actuator 14 of the present invention has an outer housing 66 defining a bore 12. Slidably received within the first end of the bore 12 is a release member 56 which is connected to piston assembly 24. The release member 56 has a radial flange 70 connected to a neck portion 21 and a stem portion 82. A portion of the first end 29 of the piston assembly 24 extends within a bias spring bore 23 in the neck portion 21 of the release member 56. The bias spring bore 23 is connected to a cavity 25 that extends a length of the stem portion 82 of the release pin 56. A compressed bias spring 9 is present within the bias spring bore 23 with a first end of the spring 9*a* in contact with the piston assembly 24 and the second end 9*b* of the bias spring 9 in contact with a pin guide 8 slidably received within the bias spring bore 23. Integrally connected to the pin guide 8 is a bias pin 7 which extends a portion of the length of the cavity 25 of the stem portion 82 of the release member 56. An end of the stem portion 82 is slidably received by a bore 27 defined by the stem portion 88 of the header 78 of the radial flange 74.

A biasing member 62 surrounds the neck portion 21 and stem portion 82 of the release member 56, as well as the header 78 of the radial flange 74, with a first end 62*a* of the biasing member 62 in contact with the radial flange 70 of the release member 56 and a second end 62*b* of the biasing member 62 in contact with the radial flange 74. The biasing member 62 moves the release member 56 outward from the housing 66, or in the direction of D, while the second end 62*b* of the biasing member 62 remains remaining stationary and in contact with the radial flange 74. The radial flange 74 prevents the firing pin 104 from ever contacting the biasing member 62, regardless of the position of the firing pin 104.

The biasing member 62, which is, in this example, a coil spring, is preferably capable of exerting between 350 and 405 pounds-force (1557 and 1802 Newtons). In alternative embodiments, other types of biasing members with their own output forces may be used.

Within a second end of the bore 12 is a solenoid assembly 50. The solenoid assembly 50 includes a solenoid 51 with at least one coil 136 connected to a power source, such as a controller 26, a bobbin 140, and a moveable plunger 132. The moveable plunger 132 receives a head 128 connected to a pull end 17 of a firing pin 104. Opposite of the head 128 of the firing pin 104 is a rod end 16 which is received by the cavity 25 within the stem portion 88 and the bore 27 defined by the header 78 of the radial flange 74.

The pull end 17 of the firing pin 104 has a first outer diameter D1 and the rod end 16 has a second outer diameter D2. The transition between the first outer diameter D1 and the second outer diameter D2 is made through a ramp section 122. The first outer diameter D1 is greater than the second outer diameter D2. A plurality of ball bearings 112 slide from the first outer diameter portion D1, down the ramp section 122 to the second outer diameter portion D2 as the firing pin 104 is moved.

Figure 4:
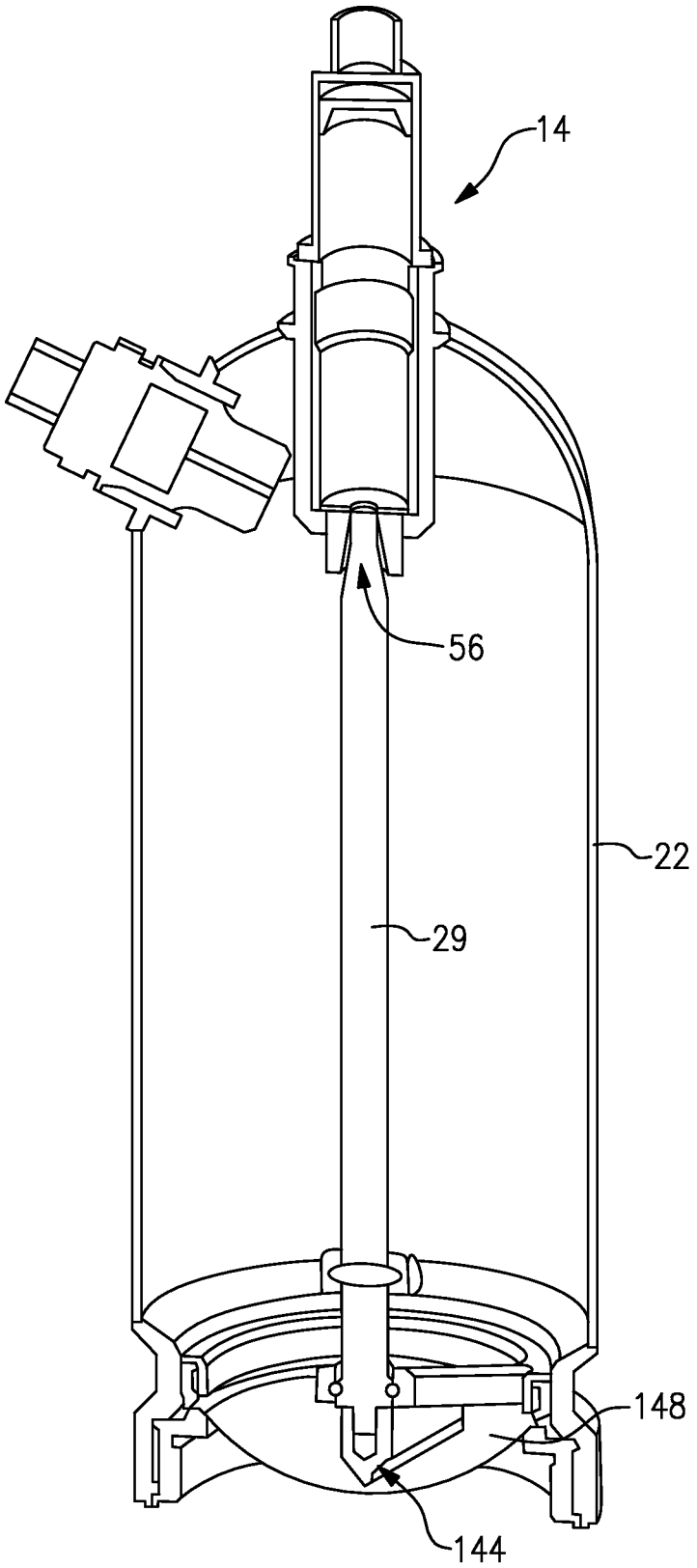
FIG. 4 shows an example detailed view of the supply and actuator in the FIG. 1 suppressant system.
Figure 5:
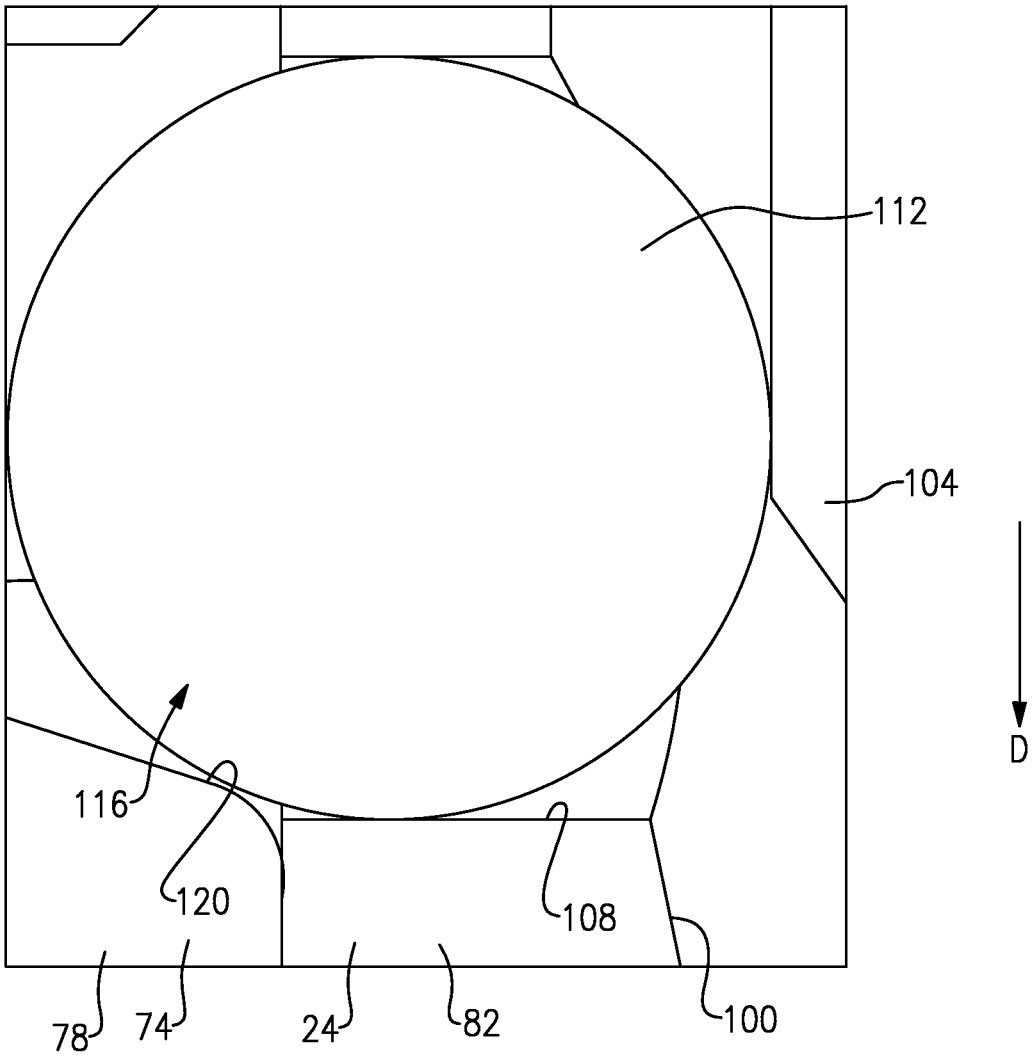
FIG. 5 shows a close-up view of the area labeled as "FIG. 5" in FIG. 2.

Bores 108 are defined in the stem portion 82 and each receive one of a plurality of ball bearings 112. The bores 108 extend radially from the bore 100 to an outer wall of the stem portion 82 (FIG. 4). When the ball bearings 112 are positioned within the bores 108, the radially outer portions 116 of the ball bearings 112 contact the flange 74 of the header 78 to hold the piston assembly 24 in the first position.

The firing pin 104 holds the ball bearings 112 within the bores 108 and against the header 78 when the piston assembly 24 is in the first, unreleased position. In this example, when the piston assembly 24 is in the first, unreleased position, the radially outer portions 116 of the ball bearings 112 contact an angled face 120 of the flange 74. The angled face 120 is angled relative to an axis of the actuator assembly 14. The first, unreleased position may also be considered a locked position.

As can be appreciated, the biasing member 62, when compressed, biases the piston assembly 24 in a direction D away from the header 78. The ball bearings 112 positioned in the bores 108 limit movement of the biasing member 62 to prevent movement of the piston assembly 24 in the direction D. Specifically, contact between the radially outer portions 116 of the ball bearings 112 and the angled face 120 of the header 78 limits movement of the piston assembly 24 toward the second position.

Figure 2:
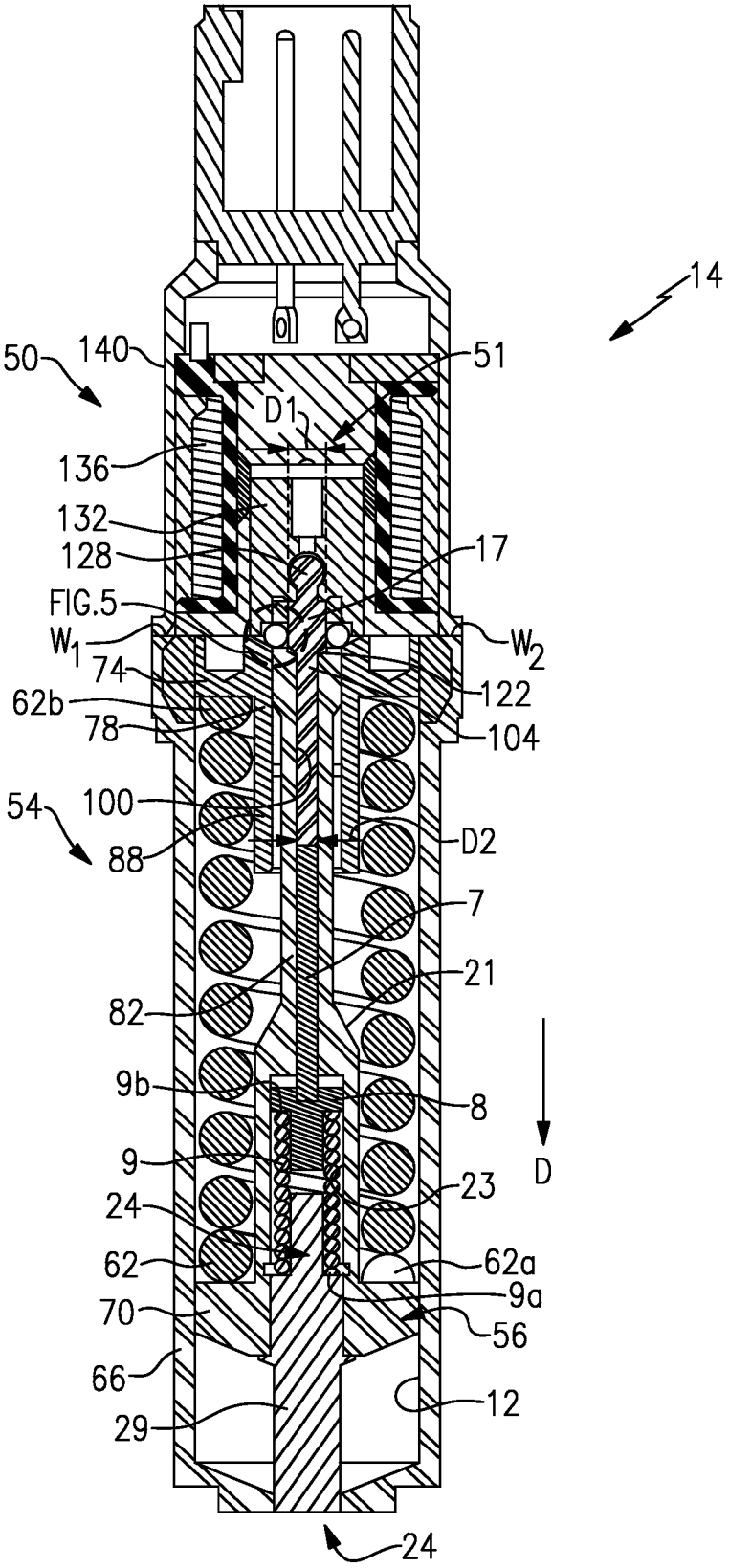
FIG. 2 shows a section view of an example suppressant actuator assembly used in the FIG. 1 system in an unreleased position.

When the suppressant actuator 14 moves the release member 56 to the unreleased position as shown in FIG. 2, the radial flange 70 of the release member 56 is not in contact with the end of the bore 12 of the outer housing 66 and the biasing member 62 is compressed. The rod end 16 of the firing pin 104 biases the bias pin 7 and the pin guide 8 connected to the piston assembly 24, further compressing the bias spring 9. The plurality of ball bearings 112 are held in place on the first outer diameter portion D1 of the firing pin 104 by friction seating on both the ramp section 120 of the radial flange 74, ramp section 122 of the firing pin 104 and the stem portion 82 of the release member 56. The unreleased position may also be considered an unlocked position.

Figure 3:
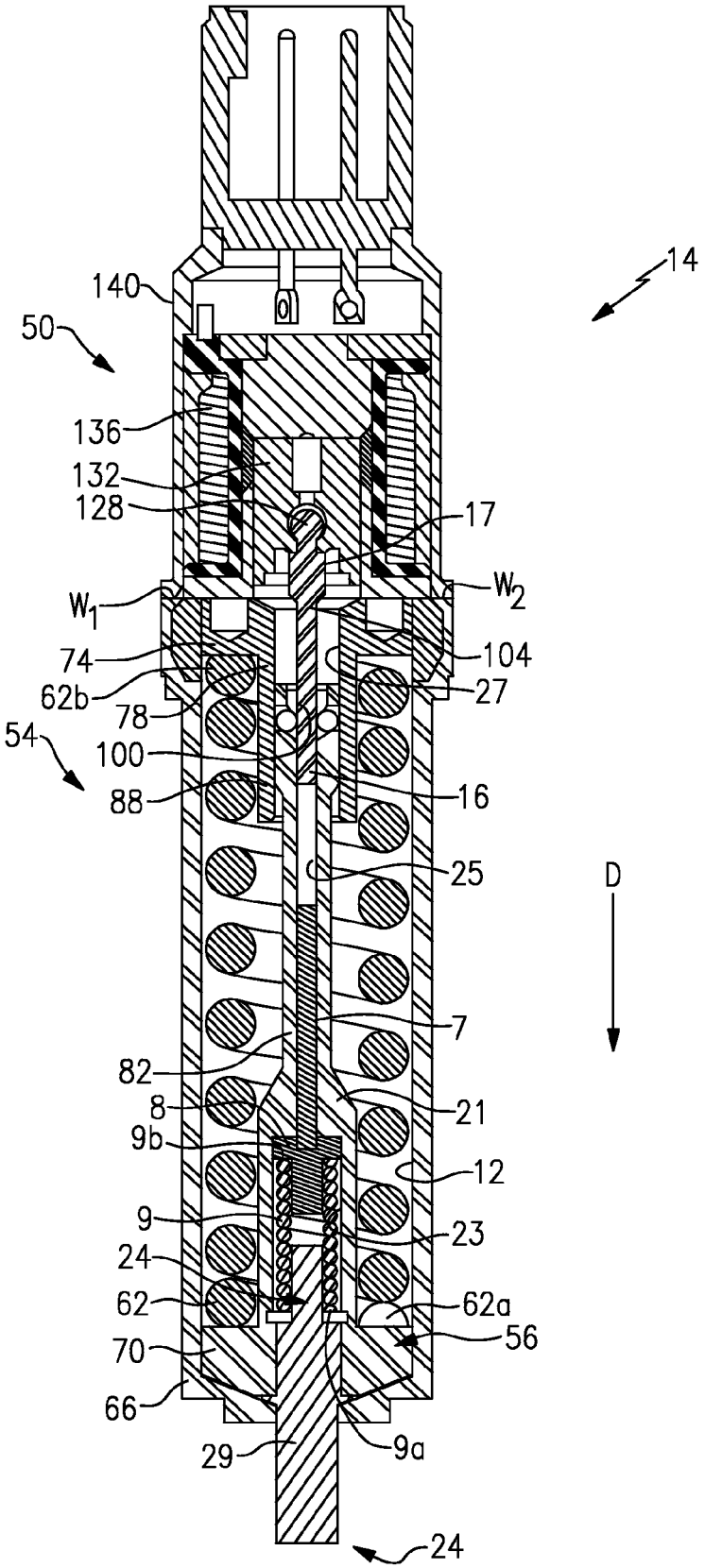
FIG. 3 shows a second view of the FIG. 2 suppressant actuator assembly in a released position.

To release the mechanism from an unreleased position to a released position as shown in FIG. 3, at least one coil 136 of the solenoid assembly 50 is energized. This pulls the moveable plunger 132 opposite the direction of D in the figure, pulling the head 128 of the pull end 17 of the firing pin 104 also in a direction opposing or opposite direction D. This motion allows the plurality of ball bearings 112 to move from the first outer diameter portion D1, of the firing pin 104 down the ramp section 122 to the second outer diameter portion D2 of the firing pin 104 and off of the ramp section 120 of the radial flange 74. The movement of the firing pin 104 in the direction opposing direction D, allows the pin guide 8 to also move in a direction opposing direction D. At the same time, the biasing member 62 biases the release member 56 and piston assembly 24 in the direction of D until the radial flange 70 of the release member 56 is in contact with the end of the bore 12.

It should be noted that the biasing member 62 remains compressed by a frictional force transmitted through the plurality of ball bearings 112 that are positioned between the firing pin 104, release member 56 and the radial flange 74. The release member 56, while compressed, is generating a force that is trying to pull the entire release member 56 outward. This force vector creates a reaction force at the ramp section 120 located on the radial flange 74. The vertical component of this force vector acting upon the plurality of ball bearings 112 creates a frictional force that inherently locks the biasing member 62 in the compressed position.

To reset the mechanism from a released position to an unreleased position, the mechanism needs to be manually reset. To reset the mechanism, the biasing member 62 and release member 56 must be compressed back to its initial position as shown in FIG. 2. By moving the release member 56 to its initial position, the bias spring 9 and firing pin 104 are also moved back to the initial position shown in FIG. 2. While the release member 56 is moving back to the initial position, the plurality of ball bearings 112 remain in place until they contact the ramped section 122 of the firing pin 104. The ramped section 122 of the firing pin 104 and the movement of the release pin 56 forces the plurality of ball bearings 112 over the ramp section 122 of the firing pin and ramp section 120 of the radial flange 74, locking the plurality of ball bearings 112 in place on the first outer diameter portion D1.

It should be noted that the force of the bias spring 9 aids the solenoid assembly 50 by providing a spring force through bias spring 9 that is in the same direction as movement of the moveable plunger 132 of the solenoid assembly 50. This positive net force reduces the work the solenoid assembly 50 must perform. The additional force provided by the bias spring 9 also allows the force output from the solenoid to be reduced and thus the size of the solenoid can be significantly reduced. In other words, the bias spring 9 acts as a force equivalent of a counterbalance, where a small amount of force has a large impact.

The suppressant actuator 14 of the present invention provides numerous advantages over conventional actuator designs. For example, the suppressant actuator of the present invention has a fast solenoid response time of approximately 4 milliseconds (ms) with the bias spring in comparison to a conventional design without a bias spring of 25 ms. A higher force output over long distances is also present within the present invention, with a force of 5 pounds-force (22 Newtons) needed in comparison to a conventional design without a bias spring of 30 pounds-force (133 Newtons). The force of the mechanism of the present invention is 425 pounds-force (1890 Newtons) of stored force, actuated with a solenoid output force of 5 pounds-force (22 Newtons). Furthermore, the mechanism of the current invention has a stroke that ranges in excess of 0.500 inches (12.7 millimeters). The power consumption of this embodiment is approximately 120 watts, in comparison to 160 watts for a conventional design without a bias spring. In addition, the package size can be made as small as approximately 0.8 inches (20.32 millimeters) in diameter by 0.8 inches (millimeters) in length.

The example suppressant actuator 14 includes four of the ball bearings 112 circumferentially surrounding the firing pin 104. In this example, the ball bearings 112 are evenly circumferentially spaced. For example, one of the ball bearings 112 is at a 12:00 position, another at a 3:00 position, etc.

In this example, the biasing member 62 and piston assembly 24 move along a common axis.

The example rupture disk 148 is relatively thin and hermetically seal welded to the supply 22, which is a cylindrical tank in this example. In one example, the suppressant actuator 14 is threaded into a fitting of the supply 22 and then hermetically seal welded to the supply 22 at areas W1 and W2. Various connectors are then secured to the suppressant actuator 14, such as MIL-DTL style round connectors or automotive-based connectors that terminate at a flying lead.

In this example, the housing 66 of the biasing assembly 54 is made of a 304L stainless steel, and the housing 140 is a 430FR stainless steel. The housing 140 is welded to the housing 66 at the areas W1 and W2. The housing 66 and the housing 140 each provide a radial flange to facilitate the hermetic seal. Other materials are used in other examples.

Sizes of the example suppressant actuator 14 are determined based on calculations of the balancing forces, strokes, reaction times, and package size requirements for the suppressant actuator 14. In some examples, tighter tolerances are used, and the mating surfaces are hardened or ceramic coated to reduce friction.

The example suppressant actuator 14 outputs 3.7 Joules of energy. Other designs provide 9-10 Joules of energy.

Features of the disclosed examples include a suppressant actuator that experiences relatively little performance degradation due to environmental conditions. The service life of some of these examples approaches 30 years, which greatly reduces the replacement intervals over prior art actuators. The example suppressant actuator has a relatively small size and provides a linear actuation.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A suppressant actuator assembly, comprising:

a release member moveable from a first position that restricts flow of a suppressant to a second position that permits flow of a suppressant;

a biasing member that moves from a more-biased position to a less-biased position to move the release member from the first position to the second position;

a solenoid that is activated to permit movement of the biasing member;

at least one bearing; and a firing pin, wherein moving the firing pin from an engaged position to a disengaged position permits movement of the at least one bearing to permit movement of the release member to the second position, wherein the release member, the biasing member, and the solenoid move along a common axis.

2. The suppressant actuator assembly of claim 1, wherein the firing pin is moveable by the solenoid from the engaged position to the disengaged position, the firing pin in the engaged position limiting more movement of the biasing member than the firing pin in the disengaged position.

3. The suppressant actuator assembly of claim 2, wherein the at least one bearing comprises a plurality of bearings circumferentially arranged about the firing pin, the bearings in a held position between a portion of the release member and a header of the release member when the firing pin is in the engaged position.

4. The suppressant actuator assembly of claim 3, wherein the bearings in the held position directly contact the firing pin, an angled face of the header, and the release member.

5. The suppressant actuator assembly of claim 1, wherein the release member moves from the first position to the second position along a first axis, and the biasing member moves from the more-biased position to the less-biased position along a second axis that is aligned with the first axis.

6. The suppressant actuator assembly of claim 5, wherein the first axis is coaxial with the second axis.

7. The suppressant actuator assembly of claim 1, wherein the biasing member comprises a coil spring.

8. The suppressant actuator assembly of claim 7, wherein the coil spring is configured to exert at least 667 Newtons of force.

9. The suppressant actuator assembly of claim 1, wherein the biasing member receives at least a portion of the release member when the release member is in the first position.

10. The suppressant actuator assembly of claim 1, wherein the suppressant comprises a fire suppressant.

11. The suppressant actuator assembly of claim 1, wherein the release member comprises a piston.

12. A suppressant system, comprising:

a controller;

a supply of a suppressant;

a release member that is moveable from a first position to a second position that permits more flow of the suppressant from the supply than the first position;

a biasing member that moves from a more-biased position to a less-biased position to move the release member from the first position to the second position;

a solenoid that is activated in response to a command from the controller to initiate movement of the biasing member from the more-biased position to the less-biased position;

at least one bearing; and a firing pin, wherein moving the firing pin from an engaged position to a disengaged position permits movement of the at least one bearing to permit movement of the release member to the second position, wherein the release member, the biasing member, and the solenoid move along a common axis.

13. The suppressant system of claim 12, wherein the controller activates the solenoid in response to detecting an increased temperature.

14. The suppressant system of claim 12, wherein at least a portion of the system is housed in an engine bay of a vehicle.

15. The suppressant system of claim 12, wherein the biasing member comprises a coil spring.

16. The suppressant system of claim 12, wherein the release member comprises a piston.

17. A method of activating a suppressant system, comprising:

activating a solenoid to move a firing pin from an engaged position to a disengaged position to permit movement of a biasing member; and using the biasing member to move a release member from a first position that restricts flow of a suppressant to a second position that permits flow of a suppressant, wherein moving the firing pin from an engaged position to a disengaged position permits movement of at least one bearing to permit movement of the release member to the second position, further comprising activating the solenoid along an axis and moving the biasing member and the release member along the same axis.

18. The method of claim 17, wherein the biasing member comprises a coil spring.

19. The method of claim 17, including puncturing a membrane with the release member to release the suppressant when the biasing member is moving from the first position to the second position.

20. A suppressant actuator assembly, comprising:

a suppressant stored in a supply container;

a release member axially moveable from a first position that restricts flow of a suppressant from the supply container to a second position that permits flow of a suppressant from the supply container;

a bias spring biasing the release member towards the second position;

a firing pin interacting with a plurality of ball bearings, the firing pin having a locked position in which the plurality of ball bearings radially interfere with movement of the release member and prevent movement of the release member from the first position to a second position, and an unlocked position in which the plurality of ball bearings are moveable radially relative to the firing pin to allow the release member to move from the first position towards the second position;

a solenoid, which when actuated moves the firing pin toward the unlocked position; and a bias pin coupled to the firing pin, biased by a spring pushing between the release member and the bias pin, to bias the bias pin and the firing pin toward the unlocked position, wherein the release member, the biasing member, and the solenoid move along a common axis.

* * * * *